US012305540B1

(12) United States Patent
Liu et al.

(10) Patent No.: US 12,305,540 B1
(45) Date of Patent: May 20, 2025

(54) FREQUENCY MODULATION AUXILIARY METHOD AND DEVICE FOR THERMAL POWER PLANT BASED ON DUAL ELECTRIC ENERGY CONVERTER

(71) Applicant: YANTAI POWER PLANT OF HUANENG SHANDONG POWER GENERATION CO., LTD., Yantai (CN)

(72) Inventors: Yantao Liu, Yantai (CN); Chunxiao Li, Yantai (CN); Likun Zheng, Yantai (CN); Jun Hao, Yantai (CN); Lianmin Ma, Yantai (CN); Zuyi Sun, Yantai (CN); Bingliang Yang, Yantai (CN); Qingjian You, Yantai (CN); Chunxia Wang, Yantai (CN); Wenjing Qin, Yantai (CN)

(73) Assignee: YANTAI POWER PLANT OF HUANENG SHANDONG POWER GENERATION CO., LTD, Shandong (CN)

( * ) Notice: Subject to any disclaimer, the term of this patent is extended or adjusted under 35 U.S.C. 154(b) by 0 days.

(21) Appl. No.: 19/062,082

(22) Filed: Feb. 25, 2025

(30) Foreign Application Priority Data

Mar. 19, 2024 (CN) ..... 202410319356.5

(51) Int. Cl.
*F01K 13/00* (2006.01)
*F01K 7/16* (2006.01)

(52) U.S. Cl.
CPC ..... *F01K 13/003* (2013.01); *F01K 7/165* (2013.01)

(58) Field of Classification Search
CPC ..... F01K 13/00; F01K 13/003; F01K 7/165; F22B 35/00; F23C 7/008; F23J 15/022;
(Continued)

(56) References Cited

U.S. PATENT DOCUMENTS 9,841,185 B2 * 12/2017 Beveridge ..... F22G 5/20
2010/0077970 A1 * 4/2010 Kumar ..... F22G 5/12 122/487
2012/0036852 A1 * 2/2012 Beveridge ..... F22G 5/12 60/645

FOREIGN PATENT DOCUMENTS

CN 206531102 U 9/2017
CN 111813160 A 10/2020
(Continued)

OTHER PUBLICATIONS

JiangBing Wu, Discussion and Research on boiler wall temperture control technology in blending coal with inferior coal, Journal, Sep. 15, 2018, Issue 09, Yunnan Chemical Industry,China.

*Primary Examiner* — Shafiq Mian
(74) *Attorney, Agent, or Firm* — Ming Jiang; OPENPTO US LLC

(57) ABSTRACT

A frequency modulation auxiliary method and device for thermal power plant based on dual electric energy converter are provided and relates to the technical field of frequency modulation in thermal power plants. The method includes: connecting a boiler power generation system of a thermal power plant with a frequency modulation auxiliary device; when frequency modulation is needed for the boiler power generation system, controlling the frequency modulation auxiliary device to operate by the controller, so as to achieve corresponding frequency; performing automatic adjustment on operation state and parameter setting of the frequency modulation auxiliary device according to real-time demand of a power system control center, so as to achieve optimal frequency modulation effect.

8 Claims, 4 Drawing Sheets

(58) Field of Classification Search
CPC . F23J 15/06; F23J 15/025; F23L 13/00; F23L 3/00; F23N 3/005; F23N 3/045; F23N 3/085; F23N 5/003; F23N 2233/00; G01N 25/20; G08B 21/18; H02J 3/241; H02J 3/466; F24D 2200/18; F24D 2200/26; F24H 2240/02
See application file for complete search history.

(56) References Cited

FOREIGN PATENT DOCUMENTS

| | | | |
|---|---|---|---|
| CN | 218097874 | U | 12/2022 |
| CN | 116464956 | A | 7/2023 |
| CN | 117212767 | A | 12/2023 |
| JP | 1999014132 | A | 1/1999 |

* cited by examiner

FREQUENCY MODULATION AUXILIARY METHOD AND DEVICE FOR THERMAL POWER PLANT BASED ON DUAL ELECTRIC ENERGY CONVERTER

CROSS-REFERENCE TO RELATED APPLICATIONS

This application claims priority of Chinese Patent Application No. 202410319356.5, filed on Mar. 19, 2024, the content of which is hereby incorporated by reference.

TECHNICAL FIELD

The disclosure relates to the technical field of frequency modulation in thermal power plants, in particular to a frequency modulation auxiliary method and device for thermal power plant based on dual electric energy converter.

BACKGROUND

Thermal power plant is the abbreviation of thermal power generating plant. Its basic production process is that fuel heats water to generate steam when burning, which converts the chemical energy of fuel into heat energy. Steam pressure drives the turbine to rotate, and heat energy is converted into mechanical energy. Then the turbine drives the generator to rotate, which converts mechanical energy into electrical energy. That is to say, the working sequence of thermal power plant is fuel-pulverizing-boiler-steam turbine-power generating plant, so as to realize the whole power generation process.

In frequency modulation of thermal power plant, it is necessary to change the fuel entering the boiler and gradually change the evaporation of the boiler, and then change the output of the steam turbine generator unit. Similarly, the speed of fuel combustion affects the overall temperature of the boiler, resulting in different evaporation of the boiler, thus affecting the output of the generator unit. Although it can be realized directly by adjusting the wind speed at present, the distance between the wind source and the boiler will lead to inconsistent wind speed, thus affecting the actual speed of fuel combustion. Therefore, in view of the above situation, it is urgent to develop a frequency modulation auxiliary method and device for thermal power plant based on dual electric energy converter, so as to overcome the shortcomings in current practical application.

SUMMARY

The disclosure provides a frequency modulation auxiliary method and device for thermal power plant based on dual electric energy converter, which are used for solving the technical problems raised by the background technology.

In order to solve the above technical problems, the disclosure provides a frequency modulation auxiliary method for thermal power plant based on dual electric energy converter, which includes the following steps:

step 1, connecting a boiler power generation system of a thermal power plant with a frequency modulation auxiliary device;

step 2, when frequency modulation is needed for the boiler power generation system, controlling the frequency modulation auxiliary device to operate by the controller, so as to achieve corresponding frequency;

step 3, performing automatic adjustment on operation state and parameter setting of the frequency modulation auxiliary device according to real-time demand of a power system control center, so as to achieve optimal frequency modulation effect.

A frequency modulation auxiliary device for a thermal power plant based on a dual electric energy converter is provided, the frequency modulation auxiliary device includes a boiler, a connecting channel, a frequency modulation auxiliary mechanism, a first air inlet pipe and a second air inlet pipe;

the connecting channel is fixedly installed at a bottom end of the boil, and a support frame is sleeved outside the boiler, and left and right sides of the connecting channel are respectively a feeding channel and an air inlet channel, and a slag outlet is fixedly installed at a bottom end of the connecting channel, and a cinder collecting box is placed at a lower end of the slag outlet, the frequency modulation auxiliary mechanism is arranged on a right side of the boiler.

Preferably, the frequency modulation auxiliary mechanism includes a frequency modulation box, where a bottom end of the frequency modulation box is fixedly provided with a plurality of support legs, a right side of the frequency modulation box is connected with a blower through a first connecting pipe, and a top end of a left side of the frequency modulation box is connected with the connecting channel through a second air inlet pipe, and a top end of the connecting channel is connected with the boiler through the first air inlet pipe, and frequency modulation assemblies are arranged in the frequency modulation box.

Preferably, a left end of the first connecting pipe is respectively communicated with a first ventilation pipeline and a second ventilation pipeline, the first ventilation pipeline and the second ventilation pipeline are respectively communicate with the second air inlet pipe and the first air inlet pipe, and frequency modulation assemblies are respectively arranged in the first ventilation pipeline and the second ventilation pipeline;

one of the frequency modulation assemblies located on a left side of the frequency modulation box includes a first gear, the first gear is arranged in a first cavity arranged in the frequency modulation box, and a left end of the first gear is fixedly installed on a first threaded rod, and a left end of the first threaded rod is threadedly connected with an adjusting plate, the adjusting plate is slidably connected in the first ventilation pipeline left and right, and the first gear is connected with a driving assembly.

Preferably, the driving assembly includes a first driving motor, the first driving motor is arranged in the frequency modulation box, and an output shaft of the first driving motor is fixedly installed at one end of a second threaded rod, and an other end of the second threaded rod is rotatably connected to an inner wall of a left end of a chute arranged at a bottom end of the first cavity, and the second threaded rod is threadedly and slidably connected with a fixed block, and the fixed block is slidably connected with an inner wall of the first cavity left and right, and a bidirectional driving motor is fixedly installed in the fixed block, and a second gear and a third gear are fixedly installed on output shafts at left and right ends of the bidirectional driving motor, and the second gear and the third gear are respectively meshed with the first gear arranged on frequency modulation assemblies at left and right ends.

Preferably, the support frame on a left side of the boiler is further provided with a boiler flue gas treatment mechanism, the boiler flue gas treatment mechanism includes a treatment box, the treatment box is fixedly installed at a top end of the support frame, and a right side of the treatment box is communicate with a smoke exhaust port of the boiler through a second connecting pipe, and a left side of the second connecting pipe is communicated with one end of a third ventilation pipeline, and an other end of the third ventilation pipeline penetrates through a flue gas waste heat recovery assembly and is communicated with a fourth ventilation pipeline, and a filter plate is fixedly installed on an inner wall of a right end of the third ventilation pipeline; and a first electromagnetic valve and a second electromagnetic valve are respectively fixedly installed on inner walls of upper and lower ends of the fourth ventilation pipeline at an outlet of a left end of the third ventilation pipeline, and a flue gas concentration detector is fixedly installed on an inner wall of a left side of the fourth ventilation pipeline between the first electromagnetic valve and the second electromagnetic valve; a bottom end of the fourth ventilation pipeline located at a bottom end of the second electromagnetic valve is communicated with an inside of the boiler through a third connecting pipe, and the fourth ventilation pipeline located at a top end of the first electromagnetic valve is connected with one end of a fourth connecting pipe, and an other end of that fourth connecting pipe is introduced into flue gas treatment liquid arranged in a second cavity, and a top end of a right side of the second cavity is connected with a smoke exhaust pipe, and the third ventilation pipeline and the fourth ventilation pipeline are both provided with flue gas conveying assemblies.

Preferably, the flue gas waste heat recovery assembly includes an annular cavity 36, the third ventilation pipeline penetrates through the annular cavity, and an annular metal plate is fixedly installed at a connecting position of the annular cavity and the third ventilation pipeline; a plurality of heat absorption plates are fixedly installed on the annular metal plate, one end of each of the heat absorption plates is located in the annular cavity, and an other end of each of the heat absorption plates is located in the third ventilation pipeline, and a water inlet pipe and a water outlet pipe are respectively fixedly arranged on the treatment box at a top end of the annular cavity from left to right.

Preferably, each of the flue gas conveying assemblies includes a second driving motor, where the second driving motor is fixedly installed on an inner wall of a right end of a third cavity arranged in the treatment box, and a first rotating shaft is fixedly installed on an output shaft of the second driving motor, and the first rotating shaft is respectively connected with a second rotating shaft in a protective shell provided for the third ventilation pipeline and the fourth ventilation pipeline through a belt assembly; and one end of the second rotating shaft penetrates through the protective shell and is fixedly connected with fan blades, and an other end of the second rotating shaft is rotatably connected with an inner wall of the protective shell, and the protective shell is fixedly installed on inner walls of the third ventilation pipeline and the fourth ventilation pipeline.

Preferably, the frequency modulation auxiliary device for a thermal power plant based on a dual electric energy converter further includes:

a first temperature sensor, used for detecting an internal actual combustion temperature of the boiler;

a second temperature sensor, used for detecting an external surface temperature of the boiler;

a third temperature sensor, used for detecting a furnace outlet temperature of the boiler;

a controller and an alarm, where the controller is electrically connected with the first temperature sensor, the second temperature sensor, the third temperature sensor and the alarm;

operating by the controller based on the first temperature sensor, the second temperature sensor, the third temperature sensor and the alarm includes:

step 1, calculating actual heat transfer coefficient K of a surface of the boiler according to formula (1) and detection values of the first temperature sensor and the second temperature sensor:

$$K = \frac{1}{a \times \left(\beta + \frac{\mu \times (T_1 - T_2)}{Z}\right) + \lambda} \tag{1}$$

where α is coal utilization coefficient, β is surface coating thermal resistance of the boiler, Z is surface heating-surface strength of the boiler, μ is system blackness, $T_1$ is a detection value of the first temperature sensor, $T_2$ is a detection value of the second temperature sensor, and/is tube wall ash scale layer thermal resistance of the boiler;

step 2, calculating coal consumption Q in the boiler in unit time according to formula (2) and a detection value of the third temperature sensor;

comparing the coal consumption Q in the boiler in unit time with a preset coal consumption range by the controller, and where when actual coal consumption is lower than the preset coal consumption range, the controller controls the alarm to give an alarm;

$$Q = \frac{c \times (5.7 \times 10^{-11} \times K \times \mu \times \delta \times S) \times (T_3 + 273)}{T_L \times (\varphi \times V) \times \rho} \tag{2}$$

where c is a flame shape coefficient in the boiler, δ is a thermal efficiency coefficient, $T_L$ is theoretical combustion temperature in the boiler, $T_3$ is a detection value of the third temperature sensor, φ is a thermal insulation coefficient of the boiler, V is average heat flow in the boiler, S is heating area inside the boiler, and ρ is coal density in the boiler.

BRIEF DESCRIPTION OF THE DRAWINGS

In order to explain the technical scheme of the disclosure or the prior art more clearly, the drawings needed in the description of the embodiments or the prior art will be briefly introduced below. Obviously, the drawings in the following description are some embodiments of the disclosure, and other drawings can be obtained according to these drawings without creative efforts for ordinary skilled in the field.

LIST OF REFERENCE CHARACTERS

1 boiler; 2 connecting channel; 3 first air inlet pipe; 4 second air inlet pipe; 5 slag outlet; 6 cinder collecting box; 7 support frame; 8 frequency modulation box; 9 support leg; 10 first connecting pipe; 11 first ventilation pipeline; 12 second ventilation pipeline; 13 first gear; 14 first cavity; 15 first threaded rod; 16 adjusting plate; 17 first driving motor; 18 second threaded rod; 19 chute; 20 fixed block; 21 bidirectional driving motor; 22 second gear; 23 third gear; 24 treatment box; 25 second connecting pipe; 26 third ventilation pipeline; 27 fourth ventilation pipeline; 28 first electromagnetic valve; 29 second electromagnetic valve; 30 flue gas concentration detector; 31 third connecting pipe; 32 fourth connecting pipe; 33 second cavity; 34 smoke exhaust pipe; 35 filter plate; 36 annular cavity; 37 annular metal plate; 38 heat absorption plate; 39 water inlet pipe; 40 water outlet pipe; 41 second driving motor; 42 third cavity; 43 first rotating shaft; 44 protective shell; 45 second rotating shaft; and 46 fan blade.

DETAILED DESCRIPTION OF THE EMBODIMENTS

In order to make the purpose, technical scheme and advantages of the disclosure more clear, the technical scheme in the disclosure will be described clearly and completely with reference to the attached drawings of the disclosure. Obviously, the described embodiments are a part of the embodiments of the disclosure, but not all of embodiments. Based on the embodiments in the disclosure, all other embodiments obtained by ordinary skilled in the field without creative efforts belong to the scope of protection of the disclosure.

In addition, in the disclosure, descriptions such as "first" and "second" are only used for description purposes, and do not specifically refer to the order or sequence, nor are they used to limit the disclosure. They are only used to distinguish assemblies or operations described in the same technical terms, and cannot be understood as indicating or implying their relative importance or implicitly indicating the number of indicated technical features. Therefore, the features defined as "first" and "second" can explicitly or implicitly include at least one of these features. In addition, the technical solutions and technical features of each embodiment can be combined with each other, but they must be based on the realization of ordinary skilled in the field. When the combination of technical solutions is contradictory or impossible, it should be considered that the combination of technical solutions does not exist and is not within the scope of protection required by the disclosure.

The disclosure provides the following embodiments.

Embodiment 1

Figure 1:
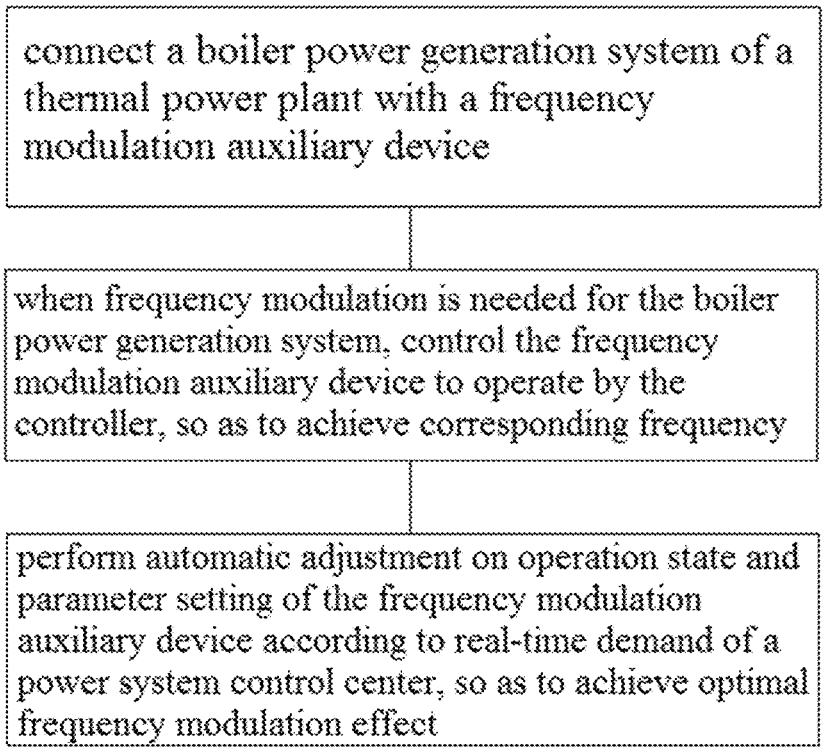
FIG. 1 is a flowchart of a frequency modulation auxiliary method according to embodiments of the disclosure.

An embodiment of the disclosure provides a frequency modulation auxiliary method for a thermal power plant based on a dual electric energy converter, as shown in FIG. 1, which includes:

step 1, a boiler power generation system of a thermal power plant is connected with a frequency modulation auxiliary device;

step 2, when frequency modulation is needed for the boiler power generation system, the controller controls the frequency modulation auxiliary device to operate, so as to achieve corresponding frequency;

step 3, automatic adjustment is performed on operation state and parameter setting of the frequency modulation auxiliary device according to real-time demand of a power system control center, so as to achieve optimal frequency modulation effect.

The technical scheme has the beneficial effects: the frequency modulation auxiliary method for a thermal power plant based on a dual electric energy converter is provided, the frequency modulation auxiliary device is connected with the boiler power generation system of the thermal power plant, the boiler power generation system of the thermal power plant is monitored in real time through the power system control center, and the operation state and parameters of the frequency modulation auxiliary device are set in real time, so that the frequency modulation capability of the thermal power plant can be effectively improved, and the stability and economy of the power system can be enhanced. It further improves the technical problem raised in background technology: the existing frequency modulation auxiliary method in thermal power plants can be realized directly by adjusting the wind speed, but the distance between the wind source and the boiler will lead to inconsistent wind speed, thus affecting the actual speed of fuel combustion.

Embodiment 2

Figure 2:
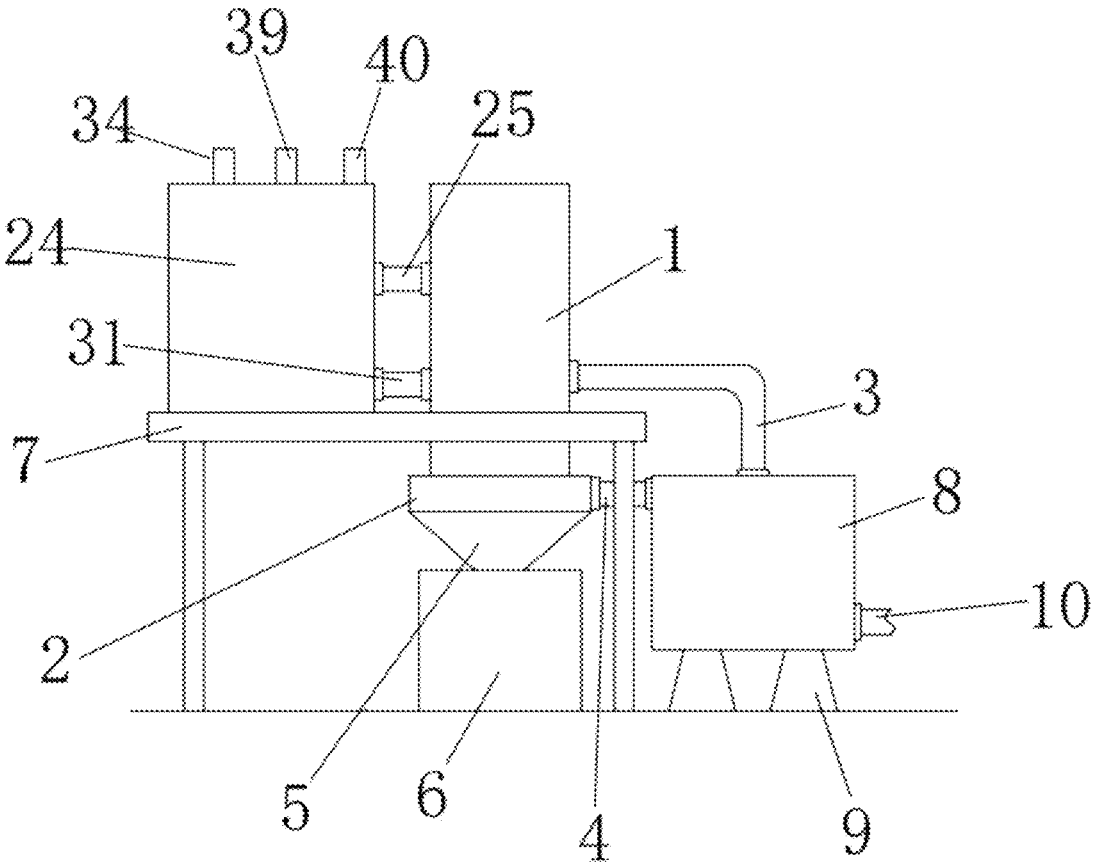
FIG. 2 is a front view of the structure of the frequency modulation auxiliary device according to embodiments of the disclosure.
Figure 3:
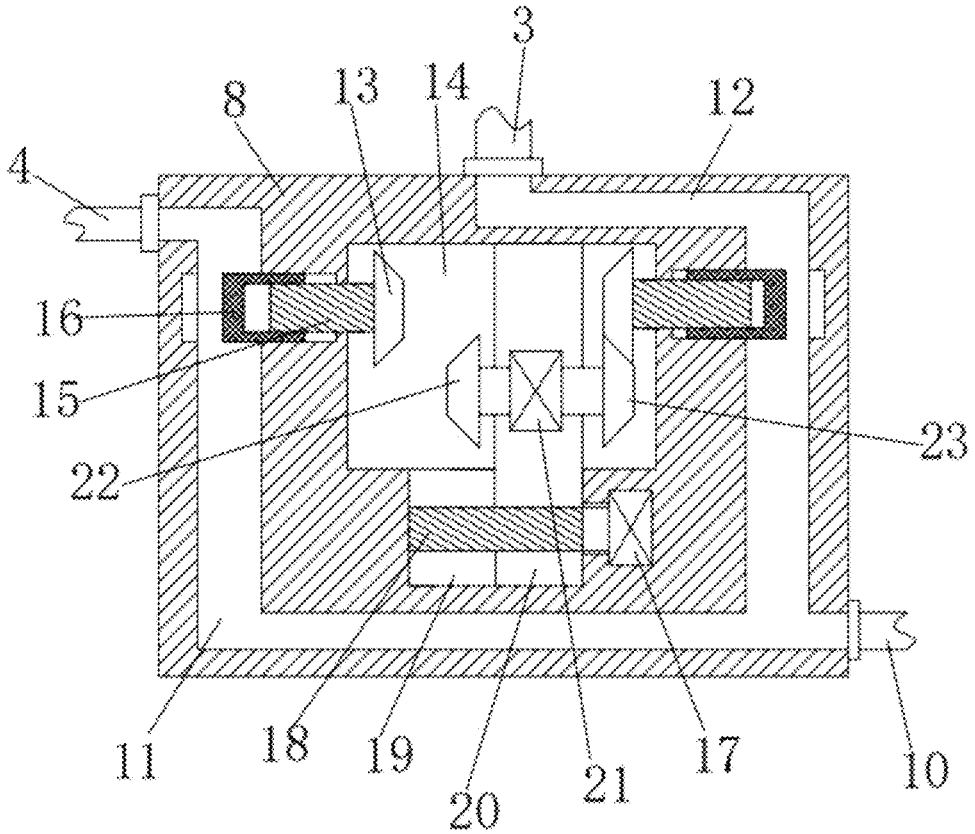
FIG. 3 is an enlarged schematic diagram of the internal structure of the frequency modulation box in FIG. 2 according to the disclosure.

On the basis of Embodiment 1, as shown in FIGS. 2-3, a frequency modulation auxiliary device for a thermal power plant based on a dual electric energy converter is provided and includes a boiler 1, a connecting channel 2, a frequency modulation auxiliary mechanism, a first air inlet pipe 3 and a second air inlet pipe 4;

the connecting channel 2 is fixedly installed at a bottom end of the boil 1, and a support frame 7 is sleeved outside the boiler 1, and left and right sides of the connecting channel 2 are respectively a feeding channel and an air inlet channel, and a slag outlet 5 is fixedly installed at a bottom end of the connecting channel 2, and a cinder collecting box 6 is placed at a lower end of the slag outlet 5, the frequency modulation auxiliary mechanism is arranged on a right side of the boiler 1.

Optionally, the frequency modulation auxiliary mechanism includes a frequency modulation box 8, where a bottom end of the frequency modulation box 8 is fixedly provided with a plurality of support legs 9, a right side of the frequency modulation box 8 is connected with a blower through a first connecting pipe 10, and a top end of a left side of the frequency modulation box 8 is connected with the connecting channel 2 through a second air inlet pipe 4, and a top end of the connecting channel 2 is connected with the boiler 1 through the first air inlet pipe 3, and frequency modulation assemblies are arranged in the frequency modulation box 8.

Optionally, a left end of the first connecting pipe 10 is respectively communicated with a first ventilation pipeline 11 and a second ventilation pipeline 12, the first ventilation pipeline 11 and the second ventilation pipeline 12 are respectively communicate with the second air inlet pipe 4 and the first air inlet pipe 3, and frequency modulation assemblies are respectively arranged in the first ventilation pipeline 11 and the second ventilation pipeline 12;

one of the frequency modulation assemblies located on a left side of the frequency modulation box 8 includes a first gear 13, the first gear 13 is arranged in a first cavity 14 arranged in the frequency modulation box 8, and a left end of the first gear 13 is fixedly installed on a first threaded rod 15, and a left end of the first threaded rod 15 is threadedly connected with an adjusting plate 16, the adjusting plate 16 is slidably connected in the first ventilation pipeline 11 left and right, and the first gear 13 is connected with a driving assembly.

Optionally, the driving assembly includes a first driving motor 17, the first driving motor 17 is arranged in the frequency modulation box 8, and an output shaft of the first driving motor 17 is fixedly installed at one end of a second threaded rod 18, and an other end of the second threaded rod 18 is rotatably connected to an inner wall of a left end of a chute 19 arranged at a bottom end of the first cavity 14, and the second threaded rod 18 is threadedly and slidably connected with a fixed block 20, and the fixed block 20 is slidably connected with an inner wall of the first cavity 14 left and right, and a bidirectional driving motor 21 is fixedly installed in the fixed block 20, and a second gear 22 and a third gear 23 are fixedly installed on output shafts at left and right ends of the bidirectional driving motor 21, and the second gear 22 and the third gear 23 are respectively meshed with the first gear 13 arranged on frequency modulation assemblies at left and right ends.

The working principle of the above technical scheme is as follows: when the air in the boiler 1 connected with the first air inlet pipe 3 or the second air inlet pipe 4 needs to be effectively frequency-modulated, firstly it is connected with the blower through the first connecting pipe 10. When only one of frequency modulation assemblies is needed (for example, only the frequency modulation assembly on the left side is used), the first driving motor 17 is firstly started, the first driving motor 17 drives the second threaded rod 18 to rotate in the chute 19, and the second threaded rod 18 rotates to drive the fixed block 20 to move to the right, so as to make the third gear 23 mesh with the first gear 13 of the frequency modulation assembly on the right side. Then the bidirectional driving motor 21 is started, the bidirectional driving motor 21 drives the first gear 13 on the right side to rotate, so as to move the adjusting plate 16 in threaded connection with the first gear 13 to the right under the action of the first threaded rod 15, until it comes into contact with the second ventilation pipeline 12 on the right side, so as to close the first gear 13 on the right side. Then the first motor 17 is reversely started, so as to move the fixed block 20 to the left end of the chute 19, so that the second gear 22 on the left side of the bidirectional driving motor 21 is connected with the frequency modulation assembly on the left side. Then the control center changes the pipeline vent area of regulating plate 16 on the left and the first ventilation pipeline 11 according to the use requirements. Finally, the blower is started, and wind is introduced into the boiler 1 through the first ventilation pipeline 11 and the second air inlet pipe 4.

When the second ventilation pipeline 12 needs to be used at the same time, the bidirectional driving motor 21 can be reversed, thereby adjusting the frequency modulation module on the right side.

The technical scheme has the beneficial effects: the left and right movement of the fixed block 20 can be effectively realized by arranging the first driving motor 17, so that the driving assembly is controlled to adjust the frequency modulation assemblies at the left and right ends. By setting the bidirectional driving motor 21, the operation of the frequency modulation assembly can be effectively changed by contacting the second gear 22 and the third gear 23 at the left and right ends of the bidirectional driving motor 21 with the frequency modulation assembly at the left and right sides, and by positively and reversely rotating the direction of the bidirectional driving motor 21. By arranging the first threaded rod 15 and the adjusting plate 16, the adjusting plate 16 can be driven to move left and right by the rotation of the first threaded rod 15, so that the gas throughput in the first ventilation pipeline 11 and the second ventilation pipeline 12 can be changed, thereby realizing effective frequency modulation. By arranging the first air inlet pipe 3 and the second air inlet pipe 4, it is beneficial to improve the amount of gas introduced through two groups of air inlet pipes, and when one group of air inlet pipes is blocked, it is very convenient and practical to ensure the effective operation of the other group of air inlet pipes.

Embodiment 3

Figure 4:
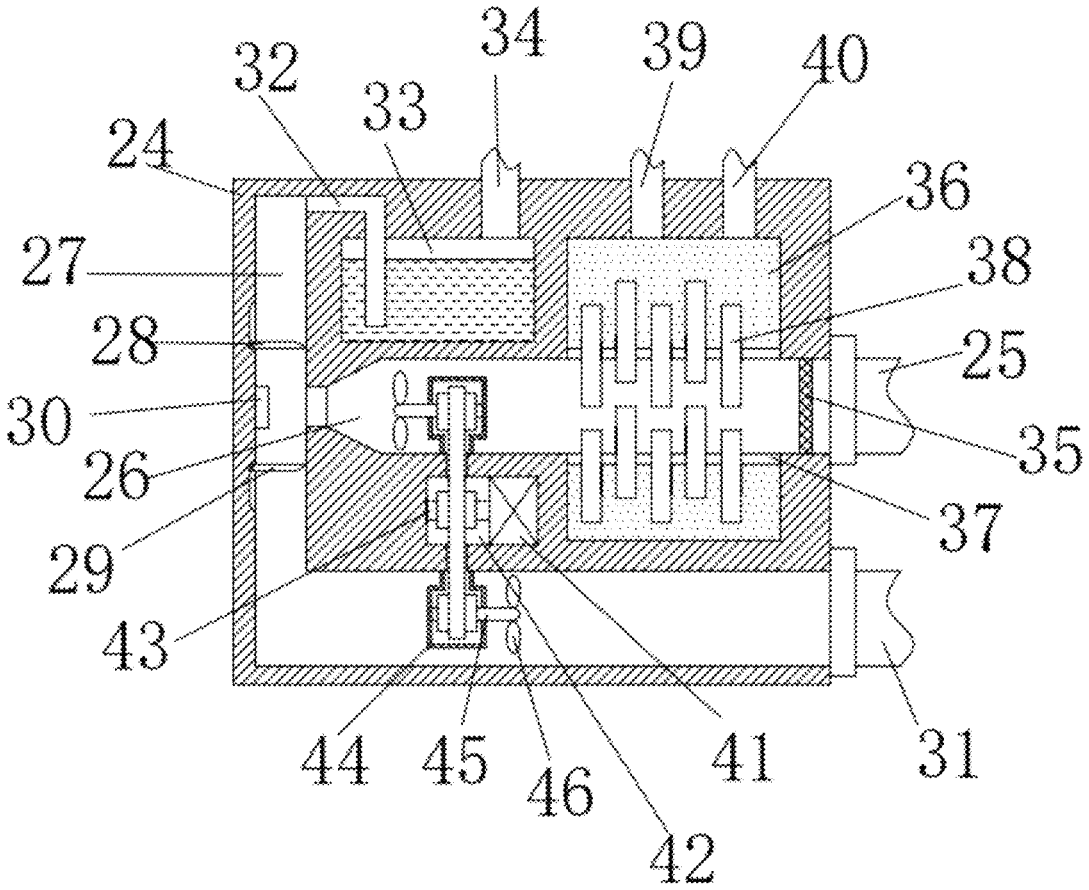
FIG. 4 is an enlarged schematic view of the internal structure of the treatment box in FIG. 2 according to the disclosure.

On the basis of Embodiment 1 or 2, as shown in FIG. 4, the frequency modulation auxiliary device for a thermal power plant based on a dual electric energy converter is provided, the support frame 7 on a left side of the boiler 1 is further provided with a boiler flue gas treatment mechanism, the boiler flue gas treatment mechanism includes a treatment box 24, the treatment box 24 is fixedly installed at a top end of the support frame 7, and a right side of the treatment box 24 is communicate with a smoke exhaust port of the boiler 1 through a second connecting pipe 25, and a left side of the second connecting pipe 25 is communicated with one end of a third ventilation pipeline 26, and an other end of the third ventilation pipeline 26 penetrates through a flue gas waste heat recovery assembly and is communicated with a fourth ventilation pipeline 27, and a filter plate 35 is fixedly installed on an inner wall of a right end of the third ventilation pipeline 26; and a first electromagnetic valve 28 and a second electromagnetic valve 29 are respectively fixedly installed on inner walls of upper and lower ends of the fourth ventilation pipeline 27 at an outlet of a left end of the third ventilation pipeline 26, and a flue gas concentration detector 30 is fixedly installed on an inner wall of a left side of the fourth ventilation pipeline 27 between the first electromagnetic valve 28 and the second electromagnetic valve 29; a bottom end of the fourth ventilation pipeline 27 located at a bottom end of the second electromagnetic valve 29 is communicated with an inside of the boiler 1 through a third connecting pipe 31, and the fourth ventilation pipeline 27 located at a top end of the first electromagnetic valve 28 is connected with one end of a fourth connecting pipe 32, and an other end of that fourth connecting pipe 32 is introduced into flue gas treatment liquid arranged in a second cavity 33, and a top end of a right side of the second cavity 33 is connected with a smoke exhaust pipe 34, and the third ventilation pipeline 26 and the fourth ventilation pipeline 27 are both provided with flue gas conveying assemblies.

Optionally, the flue gas waste heat recovery assembly includes an annular cavity 36, the third ventilation pipeline 26 penetrates through the annular cavity 36, and an annular metal plate 37 is fixedly installed at a connecting position of the annular cavity 36 and the third ventilation pipeline 26; a plurality of heat absorption plates 38 are fixedly installed on the annular metal plate 37, one end of each of the heat absorption plates 38 is located in the annular cavity 36, and an other end of each of the heat absorption plates 38 is located in the third ventilation pipeline 26, and a water inlet pipe 39 and a water outlet pipe 40 are respectively fixedly arranged on the treatment box 24 at a top end of the annular cavity 36 from left to right.

Optionally, each of the flue gas conveying assemblies includes a second driving motor 41, where the second driving motor 41 is fixedly installed on an inner wall of a right end of a third cavity 42 arranged in the treatment box 24, and a first rotating shaft 43 is fixedly installed on an output shaft of the second driving motor 41, and the first rotating shaft 43 is respectively connected with a second rotating shaft 45 in a protective shell 44 provided for the third ventilation pipeline 26 and the fourth ventilation pipeline 27 through a belt assembly; and one end of the second rotating shaft 45 penetrates through the protective shell 44 and is fixedly connected with fan blades 46, and an other end of the second rotating shaft 45 is rotatably connected with an inner wall of the protective shell 44, and the protective shell 44 is fixedly installed on inner walls of the third ventilation pipeline 26 and the fourth ventilation pipeline 27.

The working principle of the above technical scheme is as follows: when the flue gas generated by the boiler needs to be treated, the waste gas generated by the boiler 1 is conveyed to the third ventilation pipeline 26 through the filter plate 35 through the second connecting pipe 25. Then the second driving motor 41 is started, and the second driving motor 41 rotates to drive the first rotating shaft 43 to rotate, and the first rotating shaft 43 rotates to drive the second rotating shaft 45 in belt connection to rotate. The rotation of that second rotating shaft 45 drives the fan blades 46 in the third ventilating pipeline 26 and the fourth ventilating pipeline 27 to rotate along with it, so that the flue gas in the third ventilating pipeline 26 will contact with a plurality of heat absorption plates 38 in the process of being introduced, and then the heat in the flue gas will be transferred to the water in the annular cavity 36 through the heat absorption plates 38, and the water in the annular cavity 36 will be transferred to the heating system through the water outlet pipe 40. When the concentration of unburned coal gas in the flue gas detected by the flue gas concentration detector 30 exceeds the preset value, the second electromagnetic valve 29 is started (at this time, the first electromagnetic valve 28 is in the closed state), and then the gas passes through the bottom end of the fourth ventilation pipeline 27, and is conveyed to the boiler 1 again through the third connecting pipe 31 under the action of the fan blades 46 for secondary combustion. When the gas concentration detected by the flue gas concentration detector 30 is within the preset range, by starting the first electromagnetic valve 28 (at this time, the second electromagnetic valve 29 is in the closed state), the gas is transported to the gas treatment liquid in the second cavity 33 through the fourth ventilation pipeline 27 and the fourth connecting pipe 32 under the action of the fan blades 46, and then the gas pollutants in the flue gas are effectively treated through chemical reaction, and finally discharged through the smoke exhaust pipe 34.

The technical scheme has the following beneficial effects: in the disclosure, by arranging the filter plate 35, the solid impurities in the flue gas can be effectively separated by the filter plate 35, so as to prevent the solid impurities from being directly discharged into the air to pollute the air. By arranging the flue gas waste heat recovery assembly, it is beneficial to effectively recycle the heat in the flue gas through a plurality of heat absorption plates 38, so as to heat the water in the annular cavity 36, and the heated liquid can meet the daily needs through the heating system. By arranging the flue gas conveying assembly, it is beneficial to effectively convey the flue gas in the third ventilation pipeline 26 and the fourth ventilation pipeline 27. By setting the flue gas concentration detector 30, it is beneficial to detect the concentration of flue gas in the third ventilation pipeline 26, so as to realize the control of the first electromagnetic valve 28 and the second electromagnetic valve 29 and realize the different treatment of flue gas. By arranging the flue gas treatment liquid in the second cavity 33, it is beneficial to effectively treat the gas harmful to the environment in the flue gas discharged from the boiler 1, which is very convenient and practical.

Embodiment 4

On the basis of embodiments 1-3, a frequency modulation auxiliary device for a thermal power plant based on a dual electric energy converter is provided and further includes:

- a first temperature sensor, used for detecting an internal actual combustion temperature of the boiler 1;
- a second temperature sensor, used for detecting an external surface temperature of the boiler 1;
- a third temperature sensor, used for detecting a furnace outlet temperature of the boiler 1;
- a controller and an alarm, where the controller is electrically connected with the first temperature sensor, the second temperature sensor, the third temperature sensor and the alarm;
- operating by the controller based on the first temperature sensor, the second temperature sensor, the third temperature sensor and the alarm includes:
- step 1, actual heat transfer coefficient K of a surface of the boiler 1 is calculated according to formula (1) and detection values of the first temperature sensor and the second temperature sensor:

$$K = \frac{1}{a \times \left(\beta + \frac{\mu \times (T_1 - T_2)}{Z}\right) + \lambda} \tag{1}$$

where a is coal utilization coefficient, β is surface coating thermal resistance of the boiler 1, Z is surface heating-surface strength of the boiler 1, μ is system blackness (the system blackness is a correction coefficient, which is used to describe the radiation heat transfer characteristics of the actual object under the condition of non-blackbody), $T_1$ is a detection value of the first temperature sensor, $T_2$ is a detection value of the second temperature sensor, and 2 is tube wall ash scale layer thermal resistance (the unit is ($m^{2}\cdot{}^{\circ}$ C.)/kW) of the boiler 1;

- step 2, coal consumption Q in the boiler 1 in unit time is calculated according to formula (2) and a detection value of the third temperature sensor;
- the controller compares the coal consumption Q in the boiler 1 in unit time with a preset coal consumption range, and where when actual coal consumption is lower than the preset coal consumption range, the controller controls the alarm to give an alarm;

$$Q = \frac{c \times (5.7 \times 10^{-11} \times K \times \mu \times \delta \times S) \times (T_3 + 273)}{T_L \times (\varphi \times V) \times \rho} \tag{2}$$

where c is a flame shape coefficient (the value range is 0-1) in the boiler 1, δ is a thermal efficiency coefficient (the value range is 0.66-0.74), $T_L$ is theoretical combustion temperature in the boiler 1, $T_3$ is a detection value of the third temperature sensor, φ is a thermal insulation coefficient (the value range is 0.76-0.88) of the boiler 1, V is average heat flow (the unit is J/(kg·K)) in the boiler 1, S is heating area inside the boiler 1, and ρ is coal density in the boiler 1.

The technical scheme has the beneficial effects: the controller calculates the actual heat transfer coefficient of the surface of the boiler 1 based on the formula (1), the detection values of the first temperature sensor and the second temperature sensor, and the coal utilization coefficient, the surface coating thermal resistance of the boiler 1, the surface heating-surface strength of the boiler 1, the system blackness and the tube wall ash scale layer thermal resistance of the boiler 1 are comprehensively considered, so that the calculation result is more accurate and reliable.

Then, according to the formula (2) and the detection value of the third temperature sensor, and comprehensively considering the flame shape coefficient in the boiler 1, thermal efficiency coefficient, theoretical combustion temperature in the boiler 1, detection value of the third temperature sensor, thermal insulation coefficient of the boiler 1, average heat flow in the boiler 1, heating area in the boiler 1 and coal density in the boiler 1, the coal consumption in the boiler 1 in unit time is calculated, so that the calculation result is more accurate and reliable.

The controller controls the first temperature sensor, the second temperature sensor and the third temperature sensor to work, the controller compares the coal consumption in the boiler 1 with a preset coal consumption range in unit time, and when the coal consumption in the boiler 1 is lower than the preset coal consumption range in the comparison unit time, the controller controls an alarm to give an alarm and reminds workers to observe the coal combustion in the boiler 1 in time or check whether the coal conveying mechanism operates normally, thus satisfying the requirements of users for the the frequency modulation auxiliary method and device for a thermal power plant based on a dual electric energy converter.

Finally, it should be explained that the above embodiments are only used to illustrate the technical scheme of the disclosure, but not to limit it. Although the disclosure has been described in detail with reference to the foregoing embodiments, those skilled in the art should understand that it is still possible to modify the technical scheme described in the previous embodiments, or replace some technical features equally. However, these modifications or replacements do not make the essence of the corresponding technical solutions deviate from the spirit and scope of the technical solutions of various embodiments of the disclosure.

What is claimed is:

1. A frequency modulation auxiliary device for a thermal power plant based on a dual electric energy converter, comprising a boiler, a connecting channel, a frequency modulation auxiliary mechanism, a first air inlet pipe and a second air inlet pipe;

wherein the connecting channel is fixedly installed at a bottom end of the boil, and a support frame is sleeved outside the boiler, and left and right sides of the connecting channel are respectively a feeding channel and an air inlet channel, and a slag outlet is fixedly installed at a bottom end of the connecting channel, and a cinder collecting box is placed at a lower end of the slag outlet, the frequency modulation auxiliary mechanism is arranged on a right side of the boiler;

the device further comprises:

a first temperature sensor, used for detecting an internal actual combustion temperature of the boiler;

a second temperature sensor, used for detecting an external surface temperature of the boiler;

a third temperature sensor, used for detecting a furnace outlet temperature of the boiler;

a controller and an alarm, wherein the controller is electrically connected with the first temperature sensor, the second temperature sensor, the third temperature sensor and the alarm;

operating by the controller based on the first temperature sensor, the second temperature sensor, the third temperature sensor and the alarm comprises:

step 1, calculating actual heat transfer coefficient K of a surface of the boiler according to formula (1) and detection values of the first temperature sensor and the second temperature sensor;

$$K = \frac{1}{a \times \left(\beta + \frac{\mu \times (T_1 - T_2)}{Z}\right) + \lambda} \tag{1}$$

wherein α is coal utilization coefficient, β is surface coating thermal resistance of the boiler, Z is surface heating-surface strength of the boiler, μ is system blackness, $T_1$ is a detection value of the first temperature sensor, $T_2$ is a detection value of the second temperature sensor, and λ is tube wall ash scale layer thermal resistance of the boiler;

step 2, calculating coal consumption Q in the boiler in unit time according to formula (2) and a detection value of the third temperature sensor;

comparing the coal consumption Q in the boiler in unit time with a preset coal consumption range by the controller, and wherein when actual coal consumption is lower than the preset coal consumption range, the controller controls the alarm to give an alarm;

$$Q = \frac{c \times (5.7 \times 10^{-11} \times K \times \mu \times \delta \times S) \times (T_3 + 273)}{T_L \times (\varphi \times V) \times \rho} \tag{2}$$

wherein c is a flame shape coefficient in the boiler, δ is a thermal efficiency coefficient, $T_L$ is theoretical combustion temperature in the boiler, $T_3$ is a detection value of the third temperature sensor, φ is a thermal insulation coefficient of the boiler, V is average heat flow in the boiler, S is heating area inside the boiler, and ρ is coal density in the boiler.

2. The frequency modulation auxiliary device for a thermal power plant based on a dual electric energy converter according to claim 1, wherein the frequency modulation auxiliary mechanism comprises a frequency modulation box, wherein a bottom end of the frequency modulation box is fixedly provided with a plurality of support legs, a right side of the frequency modulation box is connected with a blower through a first connecting pipe, and a top end of a left side of the frequency modulation box is connected with the connecting channel through a second air inlet pipe, and a top end of the connecting channel is connected with the boiler through the first air inlet pipe, and frequency modulation assemblies are arranged in the frequency modulation box.

3. The frequency modulation auxiliary device for a thermal power plant based on a dual electric energy converter according to claim 2, wherein a left end of the first connecting pipe is respectively communicated with a first ventilation pipeline and a second ventilation pipeline, the first ventilation pipeline and the second ventilation pipeline are respectively communicate with the second air inlet pipe and the first air inlet pipe, and frequency modulation assemblies are respectively arranged in the first ventilation pipeline and the second ventilation pipeline;

one of the frequency modulation assemblies located on a left side of the frequency modulation box comprises a first gear, the first gear is arranged in a first cavity arranged in the frequency modulation box, and a left end of the first gear is fixedly installed on a first threaded rod, and a left end of the first threaded rod is threadedly connected with an adjusting plate, the adjusting plate is slidably connected in the first ventilation pipeline left and right, and the first gear is connected with a driving assembly.

4. The frequency modulation auxiliary device for a thermal power plant based on a dual electric energy converter according to claim 3, wherein the driving assembly comprises a first driving motor, the first driving motor is arranged in the frequency modulation box, and an output shaft of the first driving motor is fixedly installed at one end of a second threaded rod, and an other end of the second threaded rod is rotatably connected to an inner wall of a left end of a chute arranged at a bottom end of the first cavity, and the second threaded rod is threadedly and slidably connected with a fixed block, and the fixed block is slidably connected with an inner wall of the first cavity left and right, and a bidirectional driving motor is fixedly installed in the fixed block, and a second gear and a third gear are fixedly installed on output shafts at left and right ends of the bidirectional driving motor, and the second gear and the third gear are respectively meshed with the first gear arranged on frequency modulation assemblies at left and right ends.

5. The frequency modulation auxiliary device for a thermal power plant based on a dual electric energy converter according to claim 1, wherein the support frame on a left side of the boiler is further provided with a boiler flue gas treatment mechanism, the boiler flue gas treatment mechanism comprises a treatment box, the treatment box is fixedly installed at a top end of the support frame, and a right side of the treatment box is communicate with a smoke exhaust port of the boiler through a second connecting pipe, and a left side of the second connecting pipe is communicated with one end of a third ventilation pipeline, and an other end of the third ventilation pipeline penetrates through a flue gas waste heat recovery assembly and is communicated with a fourth ventilation pipeline, and a filter plate is fixedly installed on an inner wall of a right end of the third ventilation pipeline; and a first electromagnetic valve and a second electromagnetic valve are respectively fixedly installed on inner walls of upper and lower ends of the fourth ventilation pipeline at an outlet of a left end of the third ventilation pipeline, and a flue gas concentration detector is fixedly installed on an inner wall of a left side of the fourth ventilation pipeline between the first electromagnetic valve and the second electromagnetic valve; a bottom end of the fourth ventilation pipeline located at a bottom end of the second electromagnetic valve is communicated with an inside of the boiler through a third connecting pipe, and the fourth ventilation pipeline located at a top end of the first electromagnetic valve is connected with one end of a fourth connecting pipe, and another end of that fourth connecting pipe is introduced into flue gas treatment liquid arranged in a second cavity, and a top end of a right side of the second cavity is connected with a smoke exhaust pipe, and the third ventilation pipeline and the fourth ventilation pipeline are both provided with flue gas conveying assemblies.

6. The frequency modulation auxiliary device for a thermal power plant based on a dual electric energy converter according to claim 5, wherein the flue gas waste heat recovery assembly comprises an annular cavity, the third ventilation pipeline penetrates through the annular cavity, and an annular metal plate is fixedly installed at a connecting position of the annular cavity and the third ventilation pipeline; a plurality of heat absorption plates are fixedly installed on the annular metal plate, one end of each of the heat absorption plates is located in the annular cavity, and an other end of each of the heat absorption plates is located in the third ventilation pipeline, and a water inlet pipe and a water outlet pipe are respectively fixedly arranged on the treatment box at a top end of the annular cavity from left to right.

7. The frequency modulation auxiliary device for a thermal power plant based on a dual electric energy converter according to claim 5, wherein each of the flue gas conveying assemblies comprises a second driving motor, wherein the second driving motor is fixedly installed on an inner wall of a right end of a third cavity arranged in the treatment box, and a first rotating shaft is fixedly installed on an output shaft of the second driving motor, and the first rotating shaft is respectively connected with a second rotating shaft in a protective shell provided for the third ventilation pipeline and the fourth ventilation pipeline through a belt assembly; and one end of the second rotating shaft penetrates through the protective shell and is fixedly connected with fan blades, and an other end of the second rotating shaft is rotatably connected with an inner wall of the protective shell, and the protective shell is fixedly installed on inner walls of the third ventilation pipeline and the fourth ventilation pipeline.

8. A frequency modulation auxiliary method for a thermal power plant based on a dual electric energy converter, applied to the frequency modulation auxiliary device for a thermal power plant based on a dual electric energy converter according to claim 1, comprising:

step 1, connecting a boiler power generation system of a thermal power plant with a frequency modulation auxiliary device;

step 2, when frequency modulation is needed for the boiler power generation system, controlling the frequency modulation auxiliary device to operate by the controller, so as to achieve corresponding frequency;

step 3, performing automatic adjustment on operation state and parameter setting of the frequency modulation auxiliary device according to real-time demand of a power system control center, so as to achieve optimal frequency modulation effect.

* * * * *